US008062493B2

(12) United States Patent
Kruglick

(10) Patent No.: US 8,062,493 B2
(45) Date of Patent: Nov. 22, 2011

(54) ELECTROPHORETIC DEPOSITION

(75) Inventor: Ezekiel Kruglick, Poway, CA (US)

(73) Assignee: Empire Technology Development LLC, Wilmington, DE (US)

( * ) Notice: Subject to any disclaimer, the term of this patent is extended or adjusted under 35 U.S.C. 154(b) by 90 days.

(21) Appl. No.: 12/507,550

(22) Filed: Jul. 22, 2009

(65) Prior Publication Data

US 2011/0017598 A1 Jan. 27, 2011

(51) Int. Cl.
*C25D 17/00* (2006.01)

(52) U.S. Cl. ..... 204/622

(58) Field of Classification Search ..... 204/622
See application file for complete search history.

(56) References Cited

U.S. PATENT DOCUMENTS 6,166,847 A * 12/2000 Tench et al. ..... 359/266

FOREIGN PATENT DOCUMENTS

JP 2004-286884 * 10/2004

* cited by examiner

*Primary Examiner* — Kishor Mayekar
(74) *Attorney, Agent, or Firm* — Dorsey & Whitney LLP

(57) ABSTRACT

The present disclosure generally relates to systems, arrangements, and techniques for electrophoretic deposition of a plating material on a surface of a substrate. Example systems may include one or more of a substrate for receiving the plating material, a gel, a source element, and a conductive layer.

19 Claims, 6 Drawing Sheets

ELECTROPHORETIC DEPOSITION

BACKGROUND

Electro-plating is a plating process that uses electrical current to reduce cations of a plating material from a solution and coat an object with a thin layer of the material, such as a metal. The process used in electro-plating is called electro-deposition. Electro-plating and electro-deposition may be referred to interchangeably herein. Electro-plating typically uses material indiscriminately from a source, requiring wasteful concentrations of plating material in the solution to maintain diffusion based electro-plating concentrations.

BRIEF DESCRIPTION OF THE FIGURES

The foregoing and other features of the present disclosure will become more fully apparent form the following description and appended claims, taken in conjunction with the accompanying drawings. Understanding that these drawings depict only several examples in accordance with the disclosure and are, therefore, not to be considered limiting of its scope, the disclosure will be described with additional specificity and detail through use of the accompanying drawings.

In the drawings.

DETAILED DESCRIPTION

Figure 1:
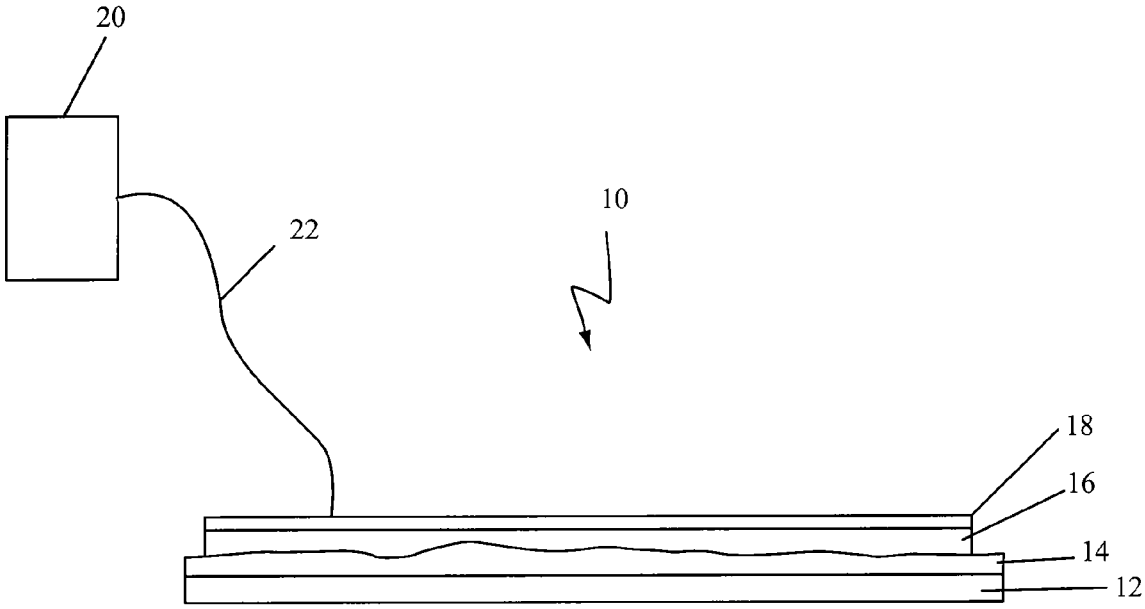
FIG. 1 illustrates a system for electro-deposition of a material on a substrate using electrophoresis.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, may be arranged, substituted, combined, separated, and designed in a wide variety of different configurations, all of which are explicitly contemplated herein.

This disclosure is drawn, inter alia, to methods, apparatus, computer programs, arrangements, and systems generally related to electroplating a plating material on a surface of a substrate using electrophoresis. Electro-deposition is an electrochemical process by which metal or other materials (referred to herein as the plating material(s)) are deposited on a substrate by passing a current through an electrolyte solution or gel containing the plating material Electrophoresis is an electrokinetic phenomenon. Electrophoretic deposition (EPD) is a colloidal process in which charged particles dispersed in a stable suspension are driven towards an oppositely charged electrode to form a particulate coating. Replacing or augmenting diffusion of traditional electroplating with electrophoresis or EPD may take advantage of electrical potentials that exist in electroplating systems and may facilitate usage of source chemicals (plating material). Such approach may reduce material needs and may offer speed and control to a plating solution or gel. A difficulty with EPD may be providing sufficient source material in the gel for the electroplating. Accordingly, various methods and systems for EPD of a plating material on a substrate as provided herein utilize a source element. Materials may be electro-deposited on a substrate relatively simply and effectively.

FIG. 1 illustrates a system 10 for electro-deposition of a material on a substrate using electrophoresis, in accordance with at least some examples of the present disclosure. As shown, the system 10 may include a substrate 12 for receiving the material, a gel 14, a source element 16, and a conductive layer 18. The system may include a first electrode, which may also be referred to as a counter electrode, and a second electrode, which may also be referred to as a reference electrode. In some examples, the conductive layer 18 may operate as the first electrode and the substrate 12 may operate as the second electrode. In some examples, the source element 16 and the conductive layer 18 may be provided as a single material. The system may further include a power source or generator 20 configured to power the electrodes such that an electric field may be generated between the first electrode and second electrode and applied across the gel and source element. The generator 20 may be electrically coupled to the first electrode (in some examples the conductive layer 18) via a wire 22.

The substrate 12 may be a material adapted to receive a plating material. Any suitable material may be used as the substrate 12, so long as it may be electro-plated upon. For example, a piezo-electric substrate such as aluminum nitride substrate material may be used. Other piezo materials, such as quartz or $PB(Zr_xTi_{1-x})O_3$ (PZT) may be used. For electronics, a thin layer of gold may be provided over the substrate. Common substrate materials for electro-plating may include piezo-electric materials, silicon on insulators (SOI or silicon on oxide) materials, oxide materials, and/or polymer materials. In some examples, the substrate 12 may be conductive and may functionally operate as the second electrode. In some examples, the substrate 12 may be coated with a conductive layer such as carbon black to form the second electrode. In other examples, the substrate 12 may not be conductive and the second electrode may be otherwise provided.

In some examples, the substrate 12 may be prepared to enhance suitability for electro-deposition. For example, the substrate 12 may be cleaned, may be coated with a hydrophilic coating, may be coated with a conductive coating such as gold, coated with an electro-plating seed layer, or otherwise prepared.

The substrate 12 may be provided of a size and shape suitable for use as an end product or may be provided of a size and shape for later subdivision or conglomeration to form an end product. Thus, in some examples, the substrate 12 may be cut or subdivided into chip sizes before electro-deposition of the plating material. In other examples, the substrate may be provided in a monolithic piece, plating material may be electro-deposited thereon, and the substrate 12 may be cut or subdivided into sizes for use thereafter. In some examples, the substrate 12 may be substantially planar. In other examples, the substrate 12 may be tubular, curved, or otherwise configured in a non-planar manner.

The gel 14 may be a gel electrolyte such as formed by a gelling agent and an organic solvent. The organic solvent may be used to dissolve the plating material and the gelling agent to create a colloid mixture. In one example, the gel 14 may be a gel electrolyte comprising polyvinylchloride as a gelling agent and tetrahydrofuran (THF) as an organic solvent. THF is a moderately polar solvent, and can dissolve a wide range of non-polar and polar chemical compounds. In some examples, the gel may be a polyacrylimide or acrylose gel. In other embodiments, the gel 14 may be a suitable electro-osmotic material. A gel-like material that is not an electrolyte generally may sustain a high voltage. The gel 14 may be provided with metal salts or electrons to sustain the electroplating process. The gel 14 thus may act as a conductive layer. In some examples, the gel 14 may functionally operate as the second electrode, such as when the substrate is not conductive. Generally, the gel 14 may have a thickness suitable for accepting stoichiometric (or waste) products that do not contribute to electroplating. Some chemistries do not produce such stoichiometric products and thus a gel layer for such chemistries may be very thin and the gel layer acts substantially only in a conductive capacity. Other chemistries, such as chrome plating, may be considered dirty wherein a plurality of stoichiometric products are produced by the electroplating chemistry and, in such chemistries, the gel layer may be more thick.

In various examples, the source element 16 may be a source gel that comprises in part the plating material. In some examples, the plating material may be provided as metal ions in a gel. Any suitable source element 16 or gel may be used. Generally, the source element 16 may contain one or more plating materials. In various examples, copper, tin, zinc, and chrome may be the plating material. The plating material may be pulled from the gel during EPD and, in some examples, the gel may be replenished and reused. In other examples, the source element 16 may comprise an alternative metal configuration from which metal ions may be pulled by electrophoretic forces. In further examples, the source element 16 may comprise ceramics such that ceramic may be electroplated onto the substrate.

In some examples, the conductive layer 18 may be a mylar foil or other material capable of conducting a charge. Aluminum, copper, silver, or other conductive material may be used as the conductive layer. Generally, the conductive layer 18 may be a sheet of material having a thickness suitable for conducting electricity.

In some examples, the counter-electrode for the electrophoretic gel may be a conductive fixture, such as one holding a source gel, or may be a liquid electrolyte of a type that does not dissolve gel (such as the gel layer or a source gel), for example salt water.

Figure 2:
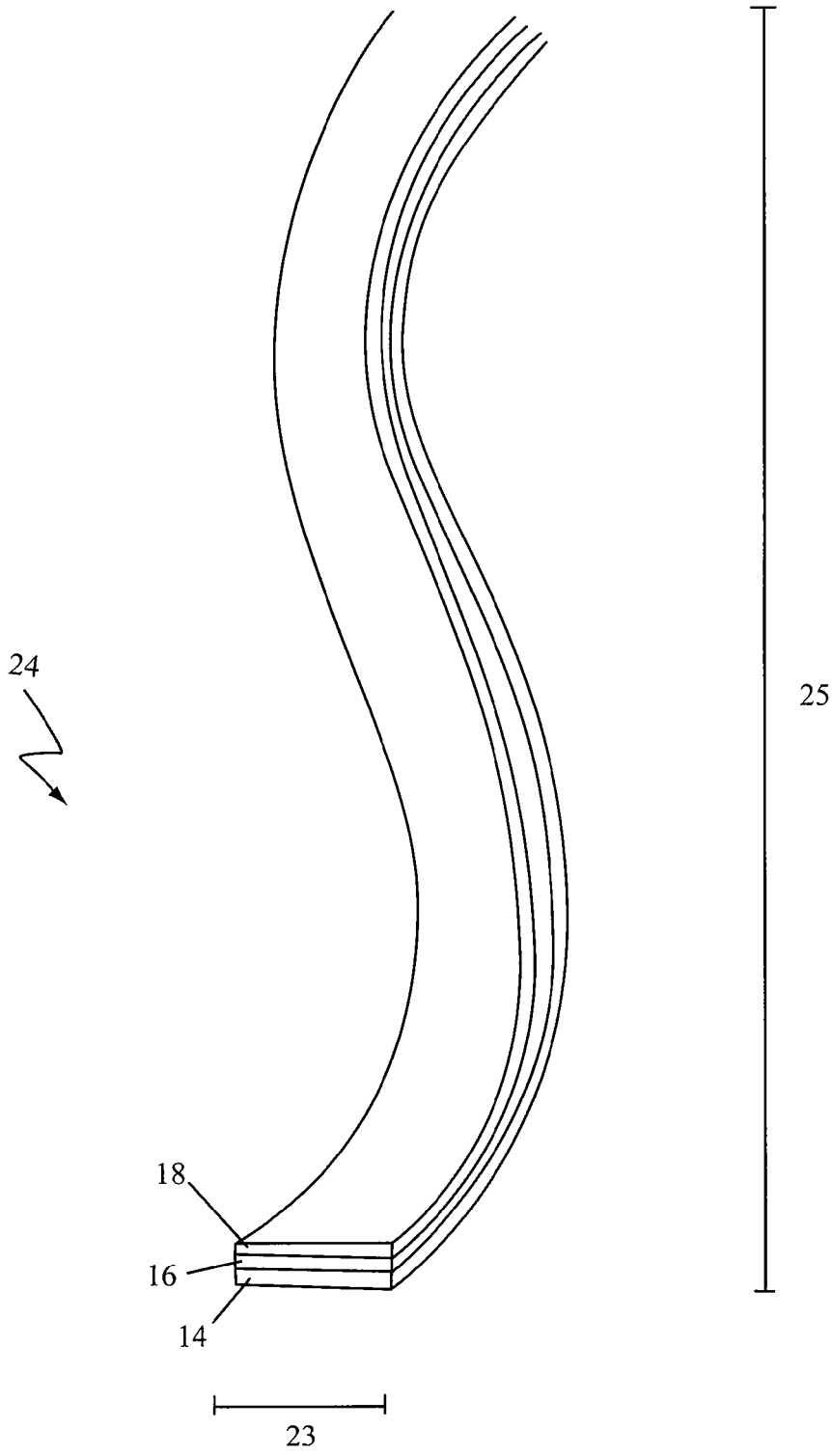
FIG. 2 illustrates an electro-plating arrangement comprising a layer tape component for use in EPD.

FIG. 2 illustrates an electro-plating arrangement comprising a layered tape component for use in EPD, in accordance with at least some examples of the present disclosure. In the example shown, the gel 14, source element 16, and conductive layer 18 may be provided as a layered tape component 24 having a long dimension 25 and a narrow dimension 23 that may be applied to a suitable substrate. The layered tape component 24 may be provided in a length that may be cut to suitable size or may be provided in a length suitable for direct application. The conductive layer may be provided, for example, as a metallic tape. On one side of the metallic tape, an electrophoretic source element may be provided. A gel electrolyte may be provided over the electrophoretic source element. In some examples, the electrophoretic source material may be, for example, 0.1 to 10 mm in thickness.

Figure 3:
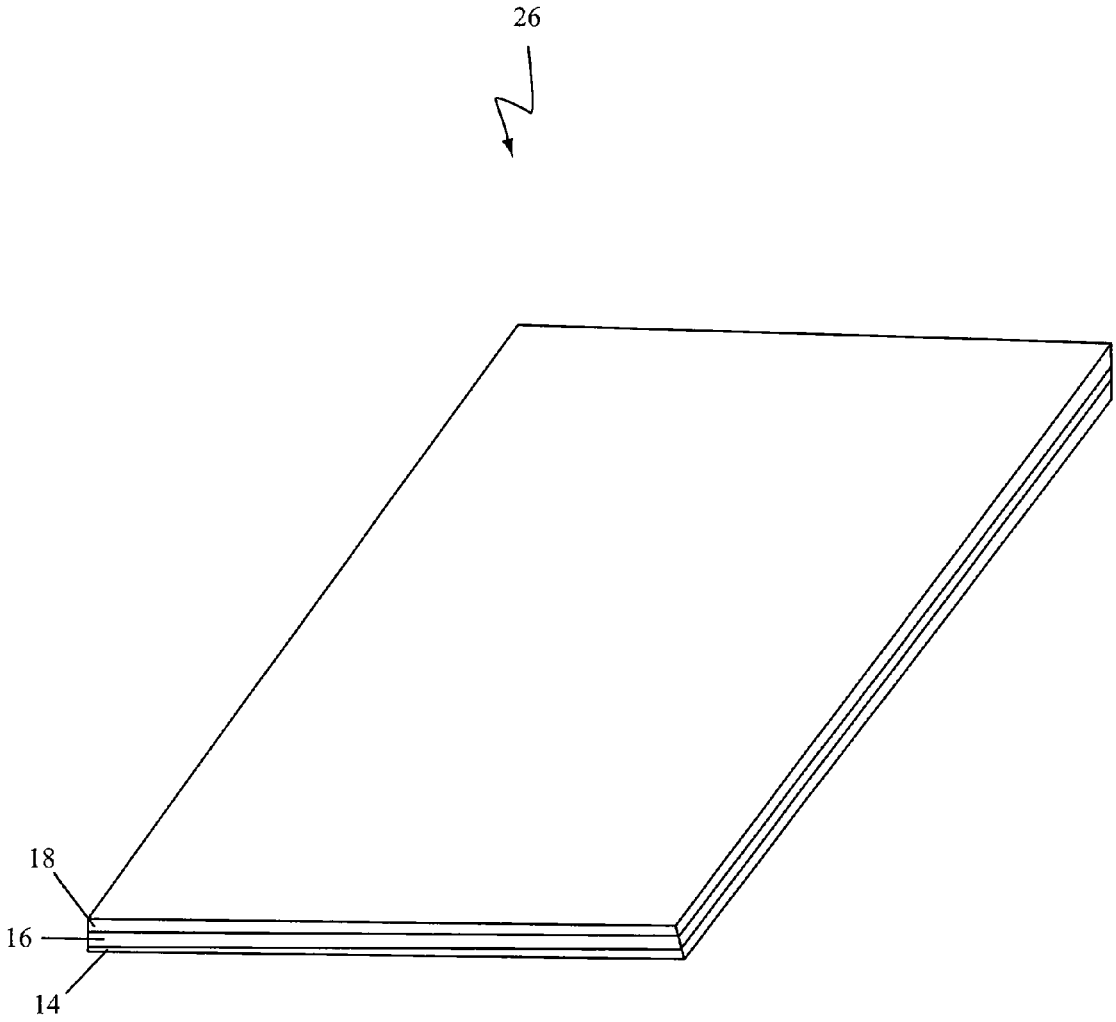
FIG. 3 illustrates an electroplating arrangement comprising a layered sheet component for use in EPD.

FIG. 3 illustrates an electro-plating arrangement comprising a layered sheet component for use in EPD, in accordance with one example. In the example shown, the gel 14, source element 16, and conductive layer 18 are provided as a layered sheet component 26. The layered sheet component 26 may be cut or subdivided into any suitable size and/or shape. The conductive layer may be provided, for example, as a metallic sheet. On one side of the metallic sheet, an electrophoretic source element may be provided. A gel electrolyte may be provided over the electrophoretic source element. In some examples, the electrophoretic source material may be, for example, in a range of approximately 0.1 mm to approximately 10 mm in thickness.

In other examples, systems and methods as provided herein may be used by providing an electrolyte gel and an electrophoretic source material in vats. In use, the electrolyte gel may be applied to a substrate and the electrophoretic source element applied over the electrolyte gel. A conductive layer may be applied over the electrophoretic source material.

Using the tape, sheet, or applied materials, patterns and shapes of material may be electroplated onto the substrate. Further, electroplating may be done on-site rather than at a plating location.

Figure 4:
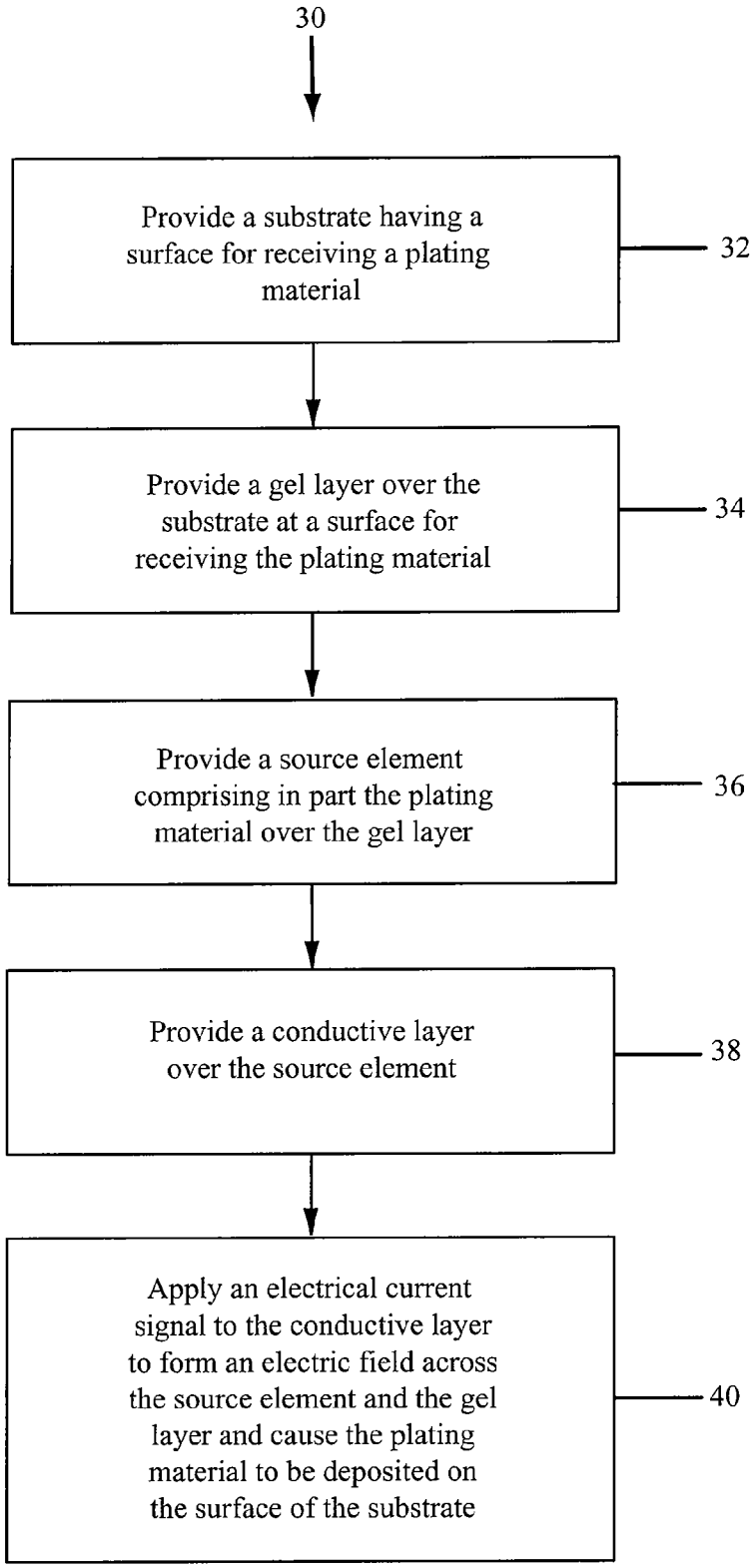
FIG. 4 illustrates a method of electro-deposition of a material on a substrate.

FIG. 4 illustrates a method 30 of electro-deposition of a material on a substrate, in accordance with at least some examples of the present disclosure. Method 30 may include one or more functional operations as illustrated by operations 32, 34, 36, 38, and/or 40. The method 30 may begin at operation 32, where a substrate having a surface for receiving a plating material may be provided. At operation 34, a gel layer may be provided over the substrate at a surface for receiving the plating material. At operation 36, a source element comprising in part the plating material may be provided over the gel layer. At operation 38, a conductive layer may be provided over the source element. At operation 40, an electrical current signal may be applied to the conductive layer to form an electric field across the source element and the gel layer and cause the plating material to be deposited on the surface of the substrate. In some examples, approximately 1-5 volts are applied.

In electrophoretic gel plating, the plating solution, such as the source element of FIG. 1, generally may have a charged plating element so that the electrostatic force may induce motion in the plating solution toward the surface. Because most electrolytes have a charge, such electrostatic force may be induced in systems and methods provided herein by using with a polar solvent. The electrophoretic systems and methods may further be used to deposit ceramics. In some example, alternating metal/ceramic plating thus may be done. Plating ions are small and a light force may be used across the gel layer to deposit the plating material. Accordingly, the applied voltage range may be less than approximately ten volts.

Reduction waste chemistries may build at the plating surface. These waste chemistries, also referred to as stoichiometric products, may accumulate in the gel layer. The stoichiometric products generally may be pumped away by the electrophoretic action of new supply materials arriving. In some examples, the chemistry may be designed such that the opposite charge may be induced during deposition such that the electrophoresis force is reversed and the undesirable chemicals are pulled away from the reaction site.

In some examples, systems and methods as described herein may further include a computing system (not shown). The computer system may be arranged to drive the signal generator or power source and may be used to control a signal level, a frequency, a period, a pulse duration, a duty cycle, an exposure time, or some other characteristic of the applied current signal. A varied frequency may in some examples increase evenness of deposition. In one particular example, a processor may be provided for controlling a frequency and/or a signal level of the current signal provided by the signal generator.

Figure 5:
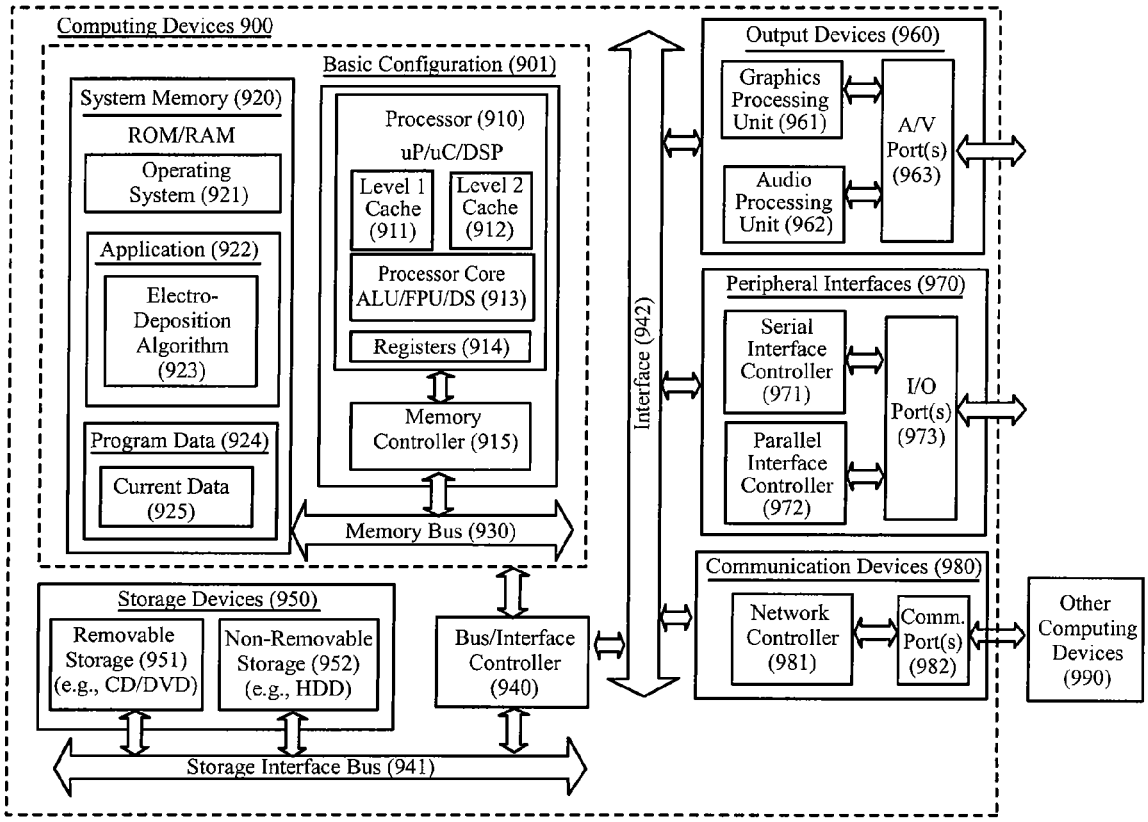
FIG. 5 is a block diagram illustrating an example computing device that is arranged for electro-deposition.

FIG. 5 is a block diagram illustrating an example computing device 900 that may be arranged for electro-deposition, in accordance with at least some examples of the present disclosure. In a very basic configuration 901, computing device 900 typically may include one or more processors 910 and system memory 920. A memory bus 930 may be used for communicating between the processor 910 and the system memory 920.

Depending on the desired configuration, processor 910 may be of any type including but not limited to a microprocessor (μP), a microcontroller (μC), a digital signal processor (DSP), or any combination thereof. Processor 910 may include one more levels of caching, such as a level one cache 911 and a level two cache 912, a processor core 913, and registers 914. An example processor core 913 may include an arithmetic logic unit (ALU), a floating point unit (FPU), a digital signal processing core (DSP Core), or any combination thereof. An example memory controller 915 may also be used with the processor 910, or in some implementations the memory controller 915 may be an internal part of the processor 910.

Depending on the desired configuration, the system memory 920 may be of any type including but not limited to volatile memory (such as RAM), non-volatile memory (such as ROM, flash memory, etc.) or any combination thereof. System memory 920 may include an operating system 921, one or more applications 922, and program data 924. Application 922 may include an electro-deposition algorithm 923 that may be arranged to generate a selected frequency. Program Data 924 includes current data 925. In some embodiments, application 922 may be arranged to operate with program data 924 on an operating system 921 such that current is supplied to electrodes to cause EPD of materials. This described basic configuration is illustrated in FIG. 3 by those components within dashed line 901.

Computing device 900 may have additional features or functionality, and additional interfaces to facilitate communications between the basic configuration 901 and any required devices and interfaces. For example, a bus/interface controller 940 may be used to facilitate communications between the basic configuration 901 and one or more data storage devices 950 via a storage interface bus 941. The data storage devices 950 may be removable storage devices 951, non-removable storage devices 952, or a combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), and tape drives to name a few. Example computer storage media may include volatile and nonvolatile, removable and non-removable media implemented in any method or technology for storage of information, such as computer readable instructions, data structures, program modules, or other data.

System memory 920, removable storage 951 and non-removable storage 952 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which may be used to store the desired information and which may be accessed by computing device 900. Any such computer storage media may be part of device 900.

Computing device 900 may also include an interface bus 942 for facilitating communication from various interface devices (e.g., output interfaces, peripheral interfaces, and communication interfaces) to the basic configuration 901 via the bus/interface controller 940. Example output devices 960 include a graphics processing unit 961 and an audio processing unit 962, which may be configured to communicate to various external devices such as a display or speakers via one or more A/V ports 963. Example peripheral interfaces 970 include a serial interface controller 971 or a parallel interface controller 972, which may be configured to communicate with external devices such as input devices (e.g., keyboard, mouse, pen, voice input device, touch input device, etc.) or other peripheral devices (e.g., printer, scanner, etc.) via one or more I/O ports 973. An example communication device 980 includes a network controller 981, which may be arranged to facilitate communications with one or more other computing devices 990 over a network communication link via one or more communication ports 982.

The network communication link may be one example of a communication media. Communication media may typically be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RF), microwave, infrared (IR) and other wireless media. The term computer readable media as used herein may include both storage media and communication media.

Computing device 900 may be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. Computing device 900 may also be implemented as a personal computer including both laptop computer and non-laptop computer configurations.

Figure 6:
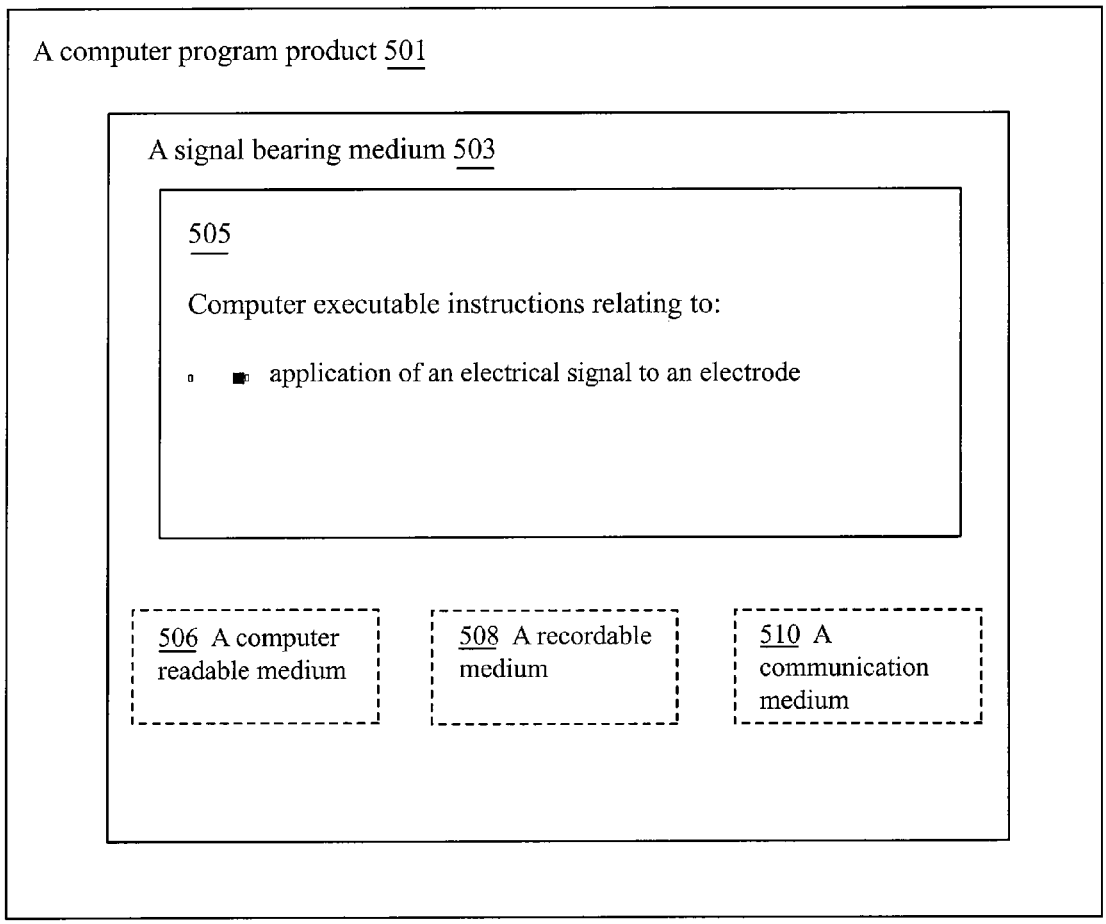
FIG. 6 illustrates a block diagram of an example computer program product; all arranged in accordance with at least some embodiments of the present disclosure.

FIG. 6 illustrates a block diagram of an example computer program product 500 arranged in accordance with at least some examples of the present disclosure. In some examples, as shown in FIG. 6, computer program product 500 includes a signal bearing medium 503 that may also include computer executable instructions 505. Computer executable instructions 505 may be arranged to provide instructions for electro-deposition. Such instructions may include, for example, instructions relating selecting or adjusting characteristics of an electrical signal and application of the electrical signal to an electrode using the selected or adjusted characteristics. Generally, the computer executable instructions may include instructions for performing any steps of the method for magnetic electro-deposition described herein.

Also depicted in FIG. 6, in some examples, computer product 500 may include one or more of a computer readable medium 506, a recordable medium 508 and a communications medium 510. The dotted boxes around these elements may depict different types of mediums that may be included within, but not limited to, signal bearing medium 503. These types of mediums may distribute computer executable instructions 505 to be executed by computer devices including processors, logic and/or other facility for executing such instructions. Computer readable medium 506 and recordable medium 508 may include, but are not limited to, a flexible disk, a hard disk drive (HDD), a Compact Disc (CD), a Digital Video Disk (DVD), a digital tape, a computer memory, etc. Communications medium 510 may include, but is not limited to, a digital and/or an analog communication medium (e.g., a fiber optic cable, a waveguide, a wired communication link, a wireless communication link, etc.).

The present disclosure is not to be limited in terms of the particular embodiments described in this application, which are intended as illustrations of various aspects. Many modifications and variations may be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which may, of course, vary. It is also to be understood that the terminology used herein is for the purpose of describing particular embodiments only, and is not intended to be limiting.

With respect to the use of substantially any plural and/or singular terms herein, those having skill in the art may translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range may be easily recognized as sufficiently describing and enabling the same range being broken down into at least equal halves, thirds, quarters, fifths, tenths, etc. As a non-limiting example, each range discussed herein may be readily broken down into a lower third, middle third and upper third, etc. As will also be understood by one skilled in the art all language such as "up to," "at least," "greater than," "less than," and the like include the number recited and refer to ranges which may be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A system for electro-depositing a plating material on a surface of a substrate, wherein the surface of the substrate is configured to receive the plating material, the system comprising:

a first gel adapted for placement on the surface of the substrate;

a source element adapted for placement on the first gel, the source element comprising the plating material and a source gel, wherein the source gel is different from the first gel, and the plating material comprises metal ions suspended in the source gel; and a conductive layer adapted for placement over the source element, wherein the conductive layer comprises a first electrode configured to couple an electrical current to the conductive layer to promote electro-deposition of the plating material on the surface of the substrate.

2. The system of claim 1 wherein the source element and the conductive layer comprise a single material.

3. The system of claim 1, further comprising a second electrode adapted such that when the electrical current is coupled to the conductive layer, an electric field is formed between the first electrode and the second electrode to promote electro-deposition of the plating material on the surface of the substrate.

4. The system of claim 3, wherein the substrate comprises the second electrode.

5. The system of claim 3, wherein the first gel comprises the second electrode.

6. The system of claim 1, wherein the first gel comprises an electrolyte gel.

7. The system of claim 6, wherein the electrolyte gel comprises polyacrylimide or acrylose gel.

8. The system of claim 1, wherein the source gel comprises an organic solvent to dissolve the plating material and a gelling agent to create a colloid mixture.

9. The system of claim 1, wherein the first gel is provided at a thickness suitable for receiving stoichiometric products from the electro-deposition of the plating material.

10. The system of claim 9, wherein the first gel is provided at a thickness of between approximately 0.1 and 10 mm.

11. The system of claim 1, wherein the metal ions comprise copper, tin, zinc, or chrome ions, or a mixture thereof.

12. The system of claim 1, wherein the plating material comprises a metal.

13. The system of claim 1, wherein the plating material comprises ceramic.

14. The system of claim 1, wherein the source element is reusable for electro-deposition steps onto multiple substrate surfaces.

15. The system of claim 1, wherein the conductive layer comprises mylar foil.

16. The system of claim 1, further comprising a power source that is configured to provide the electrical signal to the electrode.

17. The system of claim 1, wherein the first gel, the source element, and the conductive layer are provided as a layered sheet component or layered tape component.

18. The system of claim 1, wherein the first gel is not an electrolyte.

19. The system of claim 1, wherein the first gel comprises a polar solvent.

* * * * *